US011027938B2

(12) United States Patent
Watanabe et al.

(10) Patent No.: US 11,027,938 B2
(45) Date of Patent: Jun. 8, 2021

(54) MEDIUM TRANSPORT DEVICE AND IMAGE FORMING APPARATUS

(71) Applicant: FUJI XEROX CO., LTD., Tokyo (JP)

(72) Inventors: Satoshi Watanabe, Kanagawa (JP); Kiminobu Tsutada, Kanagawa (JP); Masato Minagawa, Kanagawa (JP); Hiroshi Kawamoto, Kanagawa (JP); Riwako Miyauchi, Kanagawa (JP); Tomohiro Ueno, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 182 days.

(21) Appl. No.: 16/387,559

(22) Filed: Apr. 18, 2019

(65) Prior Publication Data

US 2020/0102176 A1 Apr. 2, 2020

(30) Foreign Application Priority Data

Sep. 28, 2018 (JP) ..... JP2018-183481

(51) Int. Cl.
*B65H 29/60* (2006.01)
*B65H 5/06* (2006.01)
(Continued)

(52) U.S. Cl.
CPC ..... *B65H 29/60* (2013.01); *B65H 5/06* (2013.01); *B65H 29/58* (2013.01); *B65H 85/00* (2013.01); *B65H 2402/45* (2013.01); *B65H 2404/632* (2013.01); *B65H 2601/11* (2013.01); *G03G 2215/00713* (2013.01)

(58) Field of Classification Search
CPC ..... B65H 29/58; B65H 29/585; B65H 29/60; B65H 29/62; B65H 29/64; B65H 2404/7414; B65H 2408/111; B65H 33/14; B65H 2404/63; B65H 2404/632; B65H 6404/633; B65H 33/08; B65H 2301/162; B65H 2404/1422; B65H 2404/1424; B65H 2404/1523; B65H 2301/4219; B65H 2701/18266; B65H 2511/528;
(Continued)

(56) References Cited

U.S. PATENT DOCUMENTS 5,449,158 A 9/1995 Hirota et al.
7,489,897 B2 * 2/2009 Nakamura ..... B41J 13/106 271/176
9,708,148 B2 * 7/2017 Yoshitsugu ..... B65H 29/125

FOREIGN PATENT DOCUMENTS

JP H0616327 1/1994

* cited by examiner

*Primary Examiner* — Jeremy R Severson
(74) *Attorney, Agent, or Firm* — JCIPRNET

(57) ABSTRACT

A medium transport device includes a transporting member, a medium offsetting member, a guide member, and an interlocking member. The guide member is located upstream of the transporting member in a medium transport direction. The guide member is movable between a first position, in which the guide member guides the medium toward the medium accommodating member, and a second position, in which the guide member guides the medium to a destination different from the medium accommodating member, to guide the medium. The interlocking member moves the guide member between the first position and the second position in conjunction with a movement of the medium offsetting member in a width direction of the medium offsetting member.

14 Claims, 7 Drawing Sheets

(51) Int. Cl.
*B65H 29/58* (2006.01)
*B65H 85/00* (2006.01)

(58) Field of Classification Search
CPC . B65H 2601/11; B65H 2601/111; B65H 5/06; G03G 15/6547
See application file for complete search history.

MEDIUM TRANSPORT DEVICE AND IMAGE FORMING APPARATUS

CROSS-REFERENCE TO RELATED APPLICATIONS

This application is based on and claims priority under 35 USC 119 from Japanese Patent Application No. 2018-183481 filed Sep. 28, 2018.

BACKGROUND

(i) Technical Field

The present disclosure relates to a medium transport device and an image forming apparatus.

(ii) Related Art

Japanese Patent Application Publication No. 6-16327 ([0027] to [0032] and FIGS. 1 and 2) describes a known technology relating to image forming apparatuses, such as a copying machine, a printer, or a FAX machine, including a switching device for switching the direction in which media are transported.

Japanese Patent Application Publication No. 6-16327 describes a technology of a sorter for sorting the recording sheets. The sorter vertically moves an indexer (21) by driving a motor (10*m*), and transports sheets by winding up or rewinding a wire (24) with the driving of the motor (10*m*). Specifically, Japanese Patent Application Publication No. 6-16327 describes a technology of switching the destination of the sheets and transporting the sheets with one motor (10*m*).

SUMMARY

Aspects of non-limiting embodiments of the present disclosure relate to a medium transport device that includes fewer driving sources than a structure including a driving source dedicated for switching transport paths.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device that includes a transporting member, a medium offsetting member, a guide member, and an interlocking member. The transporting member transports a medium toward a medium accommodating member. The medium offsetting member moves the transporting member in a medium width direction to transport the medium to the medium accommodating member at positions shifted in the medium width direction. The guide member is located upstream of the transporting member in a medium transport direction, the guide member being movable between a first position, in which the guide member guides the medium toward the medium accommodating member, and a second position, in which the guide member guides the medium to a destination different from the medium accommodating member, to guide the medium. The interlocking member moves the guide member between the first position and the second position in conjunction with a movement of the medium offsetting member in a width direction of the medium offsetting member.

BRIEF DESCRIPTION OF THE DRAWINGS

Exemplary embodiments of the present disclosure will be described in detail based on the following figures, wherein:

FIG. 5A illustrates the interlocking member in a first gate position, and FIG. 5B illustrates the interlocking member in a second gate position;

FIG. 6A illustrates the interlocking member in the first gate position, and FIG. 5B illustrates the interlocking member in the second gate position; FIG. 7A illustrates the gate and the discharging roller in the first gate position, and FIG. 7B illustrates the gate and the discharging roller in the second gate position.

DETAILED DESCRIPTION

With reference to the drawings, specific examples (referred to as examples, below) of exemplary embodiments of the present disclosure will be described. The present disclosure is not limited to the following examples.

For easy understanding of the following description, throughout the drawings, an X axis direction denotes the front-rear direction, a Y axis direction denotes the lateral direction, and a Z axis direction denotes the vertical direction. The directions or sides denoted with arrows X, −X, Y, −Y, Z, and −Z are respectively referred to as forward, rearward, rightward, leftward, upward, and downward, or a front side, a rear side, a right side, a left side, an upper side, and a lower side.

Throughout the drawings, an encircled dot denotes an arrow directing from the back to the front of the sheet, and an encircled cross denotes an arrow directing from the front to the back of the sheet.

In the description with reference to the drawings, components other than those needed for the description are appropriately omitted for ease of understanding.

Example 1

Figure 1:
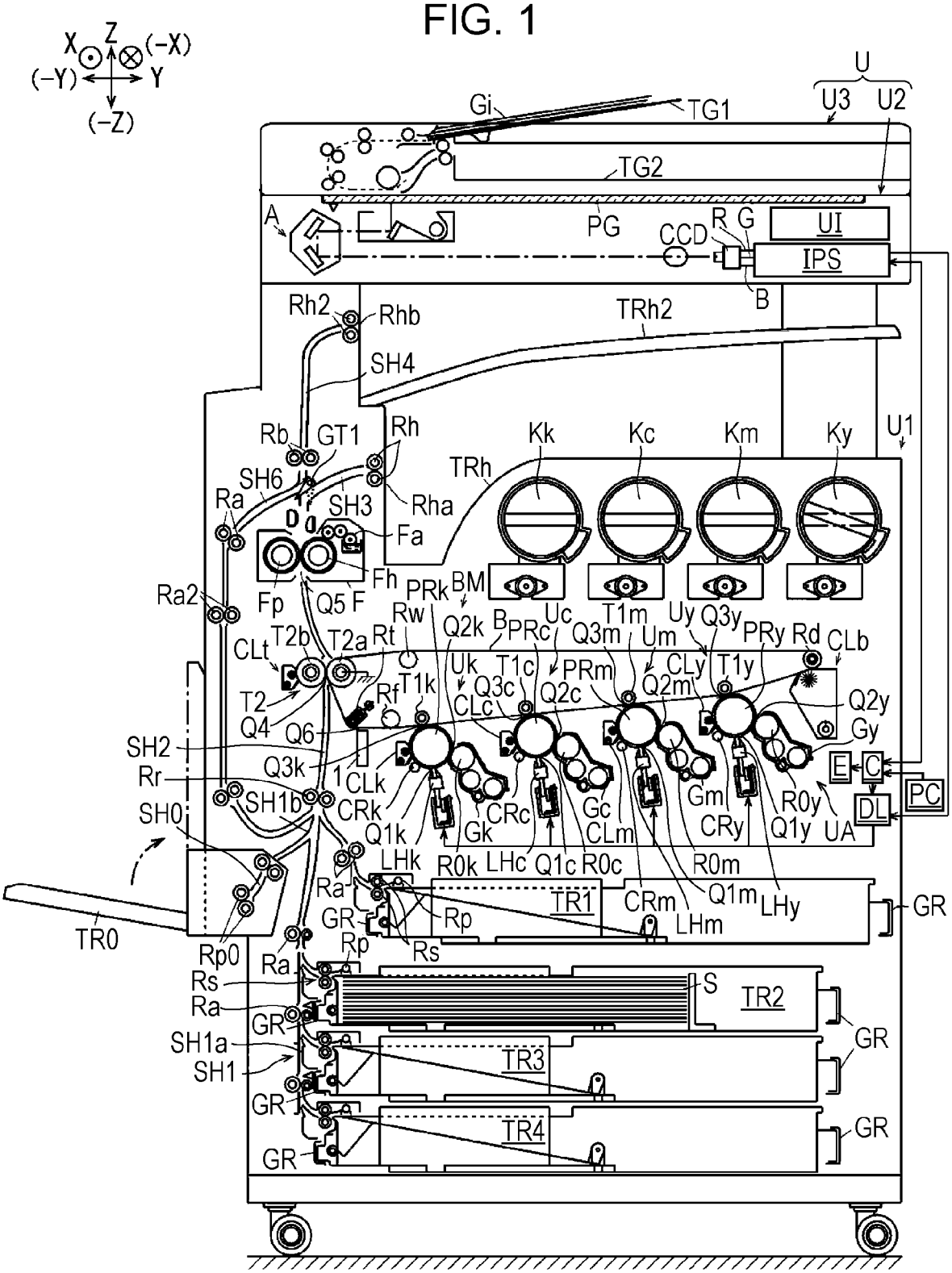
FIG. 1 illustrates the entirety of an image forming apparatus according to an example 1.

FIG. 1 illustrates the entirety of an image forming apparatus according to an example 1.

In FIG. 1, a copying machine U, which is an example of an image forming apparatus according to the example 1 of the present disclosure, includes a printer unit U1, which is an example of a recording unit and an example of an image recording device. The printer unit U1 supports, on its upper side, a scanner unit U2, which is an example of a reading unit and an example of an image reading device. The scanner unit U2 supports, on its upper side, an auto-feeder U3, which is an example of a document transporting device.

The auto-feeder U3 includes, at an upper portion, a document tray TG1, which is an example of a medium accommodating member. The document tray TG1 is capable of accommodating a stack of multiple documents Gi that are to be copied. A document output tray TG2, which is an example of a document discharge portion, is disposed below the document tray TG1. Document transport rollers U3*b* are disposed along a document transport path U3*a* connecting the document tray TG1 and the document output tray TG2.

On the upper surface of the scanner unit U2, a platen glass PG, which is an example of a transparent document table, is disposed. The scanner unit U2 according to the example 1 includes a reading unit U2*a*, which is an example of the reading unit, under the platen glass PG. The reading unit U2*a* according to the example 1 is supported to be movable in the lateral direction, which is an example of a sub-scanning direction, along the lower surface of the platen glass PG. The reading unit U2*a* is stationary in a normal state in an initial position drawn with a solid line in FIG. 1. The reading unit U2*a* is electrically connected to an image processor GS.

Figure 2:
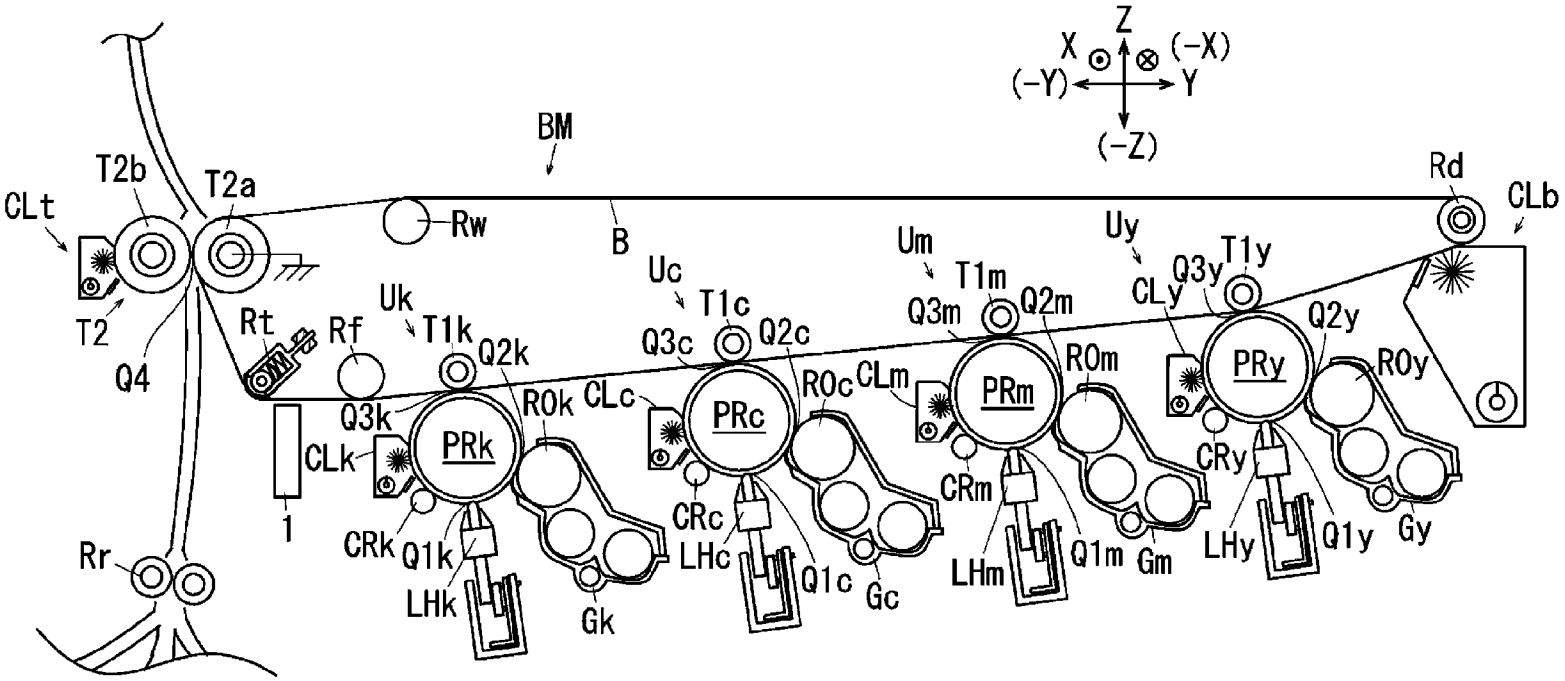
FIG. 2 illustrates a related portion of the image recording portion according to the example 1.

FIG. 2 illustrates a related portion of an image recording unit according to the example 1.

The image processor GS is electrically connected to a write circuit DL of the printer unit U1. The write circuit DL is electrically connected to exposure devices LHy, LHm, LHc, and LHk, which are an example of a latent image forming member.

The exposure devices LHy to LHk according to the example 1 are formed from, for example, LED heads each including multiple LEDs arranged in the main scanning direction. The exposure devices LHy to LHk are capable of outputting write light, corresponding to the colors Y, M, C, and K in response to signals input from the write circuit DL.

The write circuit DL or a power circuit E has write timing or power feed timing controlled in accordance with control signals from a controller C, which is an example of a controller.

In FIG. 1, photoconductors PRy, PRm, PRc, and PRk, which are an example of an image carrier, are disposed above the exposure devices LHy to LHk. In FIGS. 1 and 2, the areas of the photoconductors PRy to PRk respectively irradiated with the write light constitute write areas Q1*y*, Q1*m*, Q1*c*, and Q1*k*.

Upstream of the write areas Q1*y* to Q1*k* in the rotation direction of the photoconductors PRy, PRm, PRc, and PRk, charging rollers CRy, CRm, CRc, and CRk, which are an example of a charging member, are disposed. The charging rollers CRy to CRk according to the example 1 are supported to be driven to rotate in contact with the photoconductors PRy to PRk.

Downstream of the write areas Q1*y* to Q1*k* in the rotation direction of the photoconductors PRy to PRk, developing devices Gy, Gm, Gc, and Gk, which are an example of a developing member, are disposed. The areas over which the photoconductors PRy to PRk and the developing devices Gy to Gk face each other constitute development areas Q2*y*, Q2*m*, Q2*c*, and Q2*k*.

Downstream of the developing devices Gy to Gk in the rotation direction of the photoconductors PRy to PRk, first transfer rollers T1*y*, T1*m*, T1*c*, and T1*k*, which are an example of a first transfer member, are disposed. The areas over which the photoconductors PRy to PRk and the first transfer rollers T1*y* to T1*k* face each other constitute first transfer areas Q3*y*, Q3*m*, Q3*c*, and Q3*k*.

Downstream of the first transfer rollers T1*y* to T1*k* in the rotation direction of the photoconductors PRy to PRk, photoconductor cleaners CLy, CLm, CLc, and CLk, which are an example of a cleaner, are disposed.

The photoconductor PRy, the charging roller CRy, the exposure device LHy, the developing device Gy, the first transfer roller T1*y*, and the photoconductor cleaner CLy for the color Y constitute an image forming unit Uy for the color Y, which is an example of a visible image forming member for the color Y according to the example 1 that forms toner images for the color Y. Similarly, the photoconductors PRm, PRc, and PRk, the charging rollers CRm, CRc, and CRk, the exposure devices LHm, LHc, and LHk, the developing devices Gm, Gc, and Gk, the first transfer rollers T1*m*, T1*c*, and T1*k*, and the photoconductor cleaners CLm, CLc, and CLk constitute image forming units Um, Uc, and Uk for the colors M, C, and K.

Above the photoconductors PRy to PRk, a belt module BM, which is an example of an intermediate transfer device, is disposed. The belt module BM is an example of an image carrier, and includes an intermediate transfer belt B, which is an example of an intermediate transfer member. The intermediate transfer belt B is formed from an endless belt member.

The intermediate transfer belt B according to the example 1 is rotatably supported by a tension roller Rt, which is an example of a tension member, a walking roller Rw, which is an example of an imbalance correcting member, an idler roller Rf, which is an example of a driven member, a backup roller T2*a*, which is an example of a member opposing the second transfer area, the first transfer rollers T1*y*, T1*m*, T1*c*, and T1*k*, and a driving roller Rd, which is an example of a driving member. In the example 1, the intermediate transfer belt B rotates when the driving roller Rd receives a driving force.

At the position opposing the backup roller T2*a* across the intermediate transfer belt B, a second transfer roller T2*b*, which is an example of a second transfer member, is disposed. The backup roller T2*a*, the second transfer roller T2*b*, and other components constitute a second transfer device T2 according to the example 1, which is an example of a transfer device. The area over which the second transfer roller T2*b* and the intermediate transfer belt B come into contact with each other forms a second transfer area Q4.

Downstream of the second transfer area Q4 in the rotation direction of the intermediate transfer belt B, a belt cleaner CLb, which is an example of a device for cleaning an intermediate transfer body, is disposed.

The first transfer rollers T1*y* to T1*k*, the intermediate transfer belt B, the second transfer device T2, and other components constitute a transfer device T1+T2+B according to the example 1, which is an example of a transfer member. The image forming units Uy to Uk and the transfer device T1+T2+B constitute an image recording unit Uy+Um+Uc+Uk+T1+T2+B according to the example 1.

In FIG. 1, below the image forming units Uy to Uk, four pairs of left and right guide rails GR, which are an example of a guide member, are disposed on four levels. Each guide rail GR supports a corresponding one of sheet feed trays TR1 to TR4, which are an example of a medium accommodating member, while allowing the sheet feed tray to be inserted thereinto or removed therefrom in the front-rear direction. The sheet feed trays TR1 to TR4 accommodate recording sheets S, which are an example of a medium.

On the upper left of each of the sheet feed trays TR1 to TR4, a pickup roller Rp, which is an example of a pickup member, is disposed. Downstream of each pickup roller Rp in the direction in which the recording sheets S are transported, separation rollers Rs, which are an example of a separation member, are disposed. Downstream of the separation rollers Rs in the direction in which the recording sheets S are transported, a sheet feed path SH1, which is an example of a medium transport path, extends upward. On the sheet feed path SH1, multiple transport rollers Ra, which are an example of a transport member, are disposed.

At a lower left portion of the copying machine U, a manual tray TR0, which is an example of a medium accommodating member, is disposed. At an upper right portion of the manual tray TR0, pickup rollers Rp0 are disposed, and a manual feed path SH0 extends from the pickup rollers Rp0. The manual feed path SH0 is merged with the sheet feed path SH1.

Registration rollers Rr, which are an example of a transport timing adjusting member, are disposed on the sheet feed path SH1 upstream of the second transfer area Q4. A transport path SH2 extends from the registration rollers Rr to the second transfer area Q4.

Downstream of the second transfer area Q4 in the direction in which the recording sheets S are transported, a fixing device F, which is an example of a fixing member, is disposed. The fixing device F includes a heating roller Fh, which is an example of a heating fixing member, and a pressing roller Fp, which is an example of a pressing fixing member. The area over which the heating roller Fh and the pressing roller Fp come into contact with each other constitutes a fixing area Q5.

On the upper surface of the printer unit U1, a lower paper output tray TRh, which is an example of a medium output portion, is disposed. A paper output path SH3, which is an example of a medium transport member, extends toward the lower paper output tray TRh above the fixing device F. At the downstream end of the paper output path SH3, output rollers Rh, which are an example of a medium transport member, are disposed.

Above the lower paper output tray TRh, an upper paper output tray TRh2, which is an example of a medium output portion, is disposed. Above the fixing device F, an upper transport path SH4, which diverges from the paper output path SH3, extends toward the upper paper output tray TRh2.

On the upper transport path SH4, reversing rollers Rb rotatable forward and rearward, which are an example of a medium transport member, are disposed. Above the point of divergence between the paper output path SH3 and the upper transport path SH4, a reverse path SH6, which is an example of a medium transport path, diverges downward to the left from the upper transport path SH4. A gate GT1, which is an example of a switching member, is disposed across the point of divergence between the paper output path SH3 and the upper transport path SH4 and the point of divergence between the upper transport path SH4 and the reverse path SH6. The gate GT1 is supported to be switchable between a first guide position (second position), in which it guides a recording sheet S from the fixing device F toward the lower paper output tray TRh and guides a recording sheet S from the upper transport path SH4 to the reverse path SH6, and a second guide position (first position), in which it guides a recording sheet S from the fixing device F to the upper transport path SH4.

On the reverse path SH6, multiple transport rollers Ra, which are an example of a medium transport member, are disposed. The reverse path SH6 has its downstream end merged to the sheet feed path SH1 at a portion upstream of the registration rollers Rr.

Description of Image Forming Operation

When an operator manually places a document Gi on the platen glass PG of the copying machine U according to the example 1 having the above structure for photocopying, the reading unit U2*a* moves in the lateral direction from the initial position to scan the document Gi on the platen glass PG while exposing the document Gi to light. When the auto-feeder U3 is used to automatically transport the documents Gi for photocopying, the reading unit U2*a* moves from the initial position to a document read position, indicated with a broken line in FIG. 1, and remains stationary. Thereafter, the multiple documents Gi accommodated in the document tray TG1 are sequentially transported to the document read position on the platen glass PG, and then passes the document read position to be discharged onto the document output tray TG2. The documents Gi that sequentially pass the read position on the platen glass PG are exposed to light and scanned by the stationary reading unit U2*a*. Light reflected off the documents Gi is received by the reading unit U2*a*. The reading unit U2*a* converts the received light reflected off the documents Gi into electric signals. To perform double-sided reading of a document Gi, a read sensor U3*d* also reads the document Gi.

The image processor GS receives electric signals output from the reading unit U2*a*. The image processor GS converts the electric signals of images of the colors R, G, and B read by the reading unit U2*a* into image information of yellow Y, magenta M, cyan C, and black K for latent image formation. The image processor GS outputs the converted image information to the write circuit DL of the printer unit U1. The image processor GS outputs the image information for only black K to the write circuit DL when an image is a single-color image, or a monochrome image.

The write circuit DL outputs control signals corresponding to the input image information to the exposure devices LHy to LHk. The exposure devices LHy to LHk output the write light corresponding to the control signals.

The photoconductors PRy to PRk rotate in response to the start of image formation. The charging rollers CRy to CRk receive a charging voltage from the power circuit E. Thus, the photoconductors PRy to PRk have their surfaces electrically charged by the charging rollers CRy to CRk. Electrostatic latent images are formed in the write areas Q1*y* to Q1*k* on the surfaces of the electrically charged photoconductors PRy to PRk with the laser beams Ly to Lk. The electrostatic latent images on the photoconductors PRy to PRk are developed into toner images, which are an example of a visible image, by the developing devices Gy, Gm, Gc, and Gk in the development areas Q2*y* to Q2*k*.

The developed toner images are transported to the first transfer areas Q3*y*, Q3*m*, Q3*c*, and Q3*k*, at which they come into contact with the intermediate transfer belt B, which is an example of an intermediate transfer body. In the first transfer areas Q3*y*, Q3*m*, Q3*c*, and Q3*k*, the first transfer rollers T1*y* to T1*k* receive, from the power circuit E, a first transfer voltage having a polarity opposite to the polarity with which the toner is charged. Thus, the toner images on the photoconductors PRy to PRk are transferred to the intermediate transfer belt B by the first transfer rollers T1*y* to T1*k*. To form a multi-color toner image, a toner image on the downstream side is transferred to the intermediate transfer belt B to be superposed on a toner image that has been transferred to the intermediate transfer belt B in the upstream first transfer area.

Remnants or deposits left on the photoconductors PRy to PRk after a first transfer are respectively removed by the photoconductor cleaners CLy to CLk. The surfaces of the cleaned photoconductors PRy to PRk are respectively electrically recharged by the charging rollers CRy to CRk.

Single-color or multi-color toner images transferred onto the intermediate transfer belt B by the first transfer rollers T1*y* to T1*k* in the first transfer areas Q3*y* to Q3*k* are transported to the second transfer area Q4.

Recording sheets S on which images are to be recorded are picked up by the pickup roller Rp of an appropriate one of the sheet feed trays TR1 to TR4. The recording sheets S picked up by the pickup roller Rp while being stacked together are separated one from another by the separation rollers Rs. The recording sheets S separated by the separation rollers Rs are transported along the sheet feed path SH1 by the transport rollers Ra. The recording sheets S transported along the sheet feed path SH1 are fed to the registration rollers Rr. The recording sheets S placed on the manual tray TR0 are also fed to the sheet feed path SH1 through the manual feed path SH0 by the pickup rollers Rp0.

The registration rollers Rr transport a recording sheet S to the second transfer area Q4 at the timing when a toner image formed on the intermediate transfer belt B is transported to the second transfer area Q4. The second transfer roller T2*b* receives, from the power circuit E, a second transfer voltage having a polarity opposite to the polarity with which toner is charged. Thus, the toner image on the intermediate transfer belt B is transferred to the recording sheet S from the intermediate transfer belt B.

After the second transfer, the intermediate transfer belt B is cleaned by the belt cleaner CLb to remove deposits or other matters adhering to the surface.

The recording sheet S to which the toner image has been second-transferred is heated to have the toner image fixed while passing the fixing area Q5.

When the recording sheet S having an image fixed thereto is discharged to the lower paper output tray TRh, the gate GT1 is moved to the first guide position. The recording sheet S discharged from the fixing device F is thus transported along the paper output path SH3. The recording sheet S transported along the paper output path SH3 is discharged to the lower paper output tray TRh by the output rollers Rh.

When the recording sheet S is to be discharged to the upper paper output tray TRh2, the gate GT1 is moved to the second guide position to allow the recording sheet S to be discharged to the upper paper output tray TRh2.

When the recording sheet S is to be subjected to double-side printing, the gate GT1 is moved to the second guide position. When the recording sheet S has its trailing end passing the gate GT1, the gate GT1 is moved to the first guide position, and the reversing rollers Rb rotate rearward. Thus, the recording sheet S is guided to the gate GT1, and transported to the reverse path SH6.

Description of Gate Movement Mechanism

Figure 3:
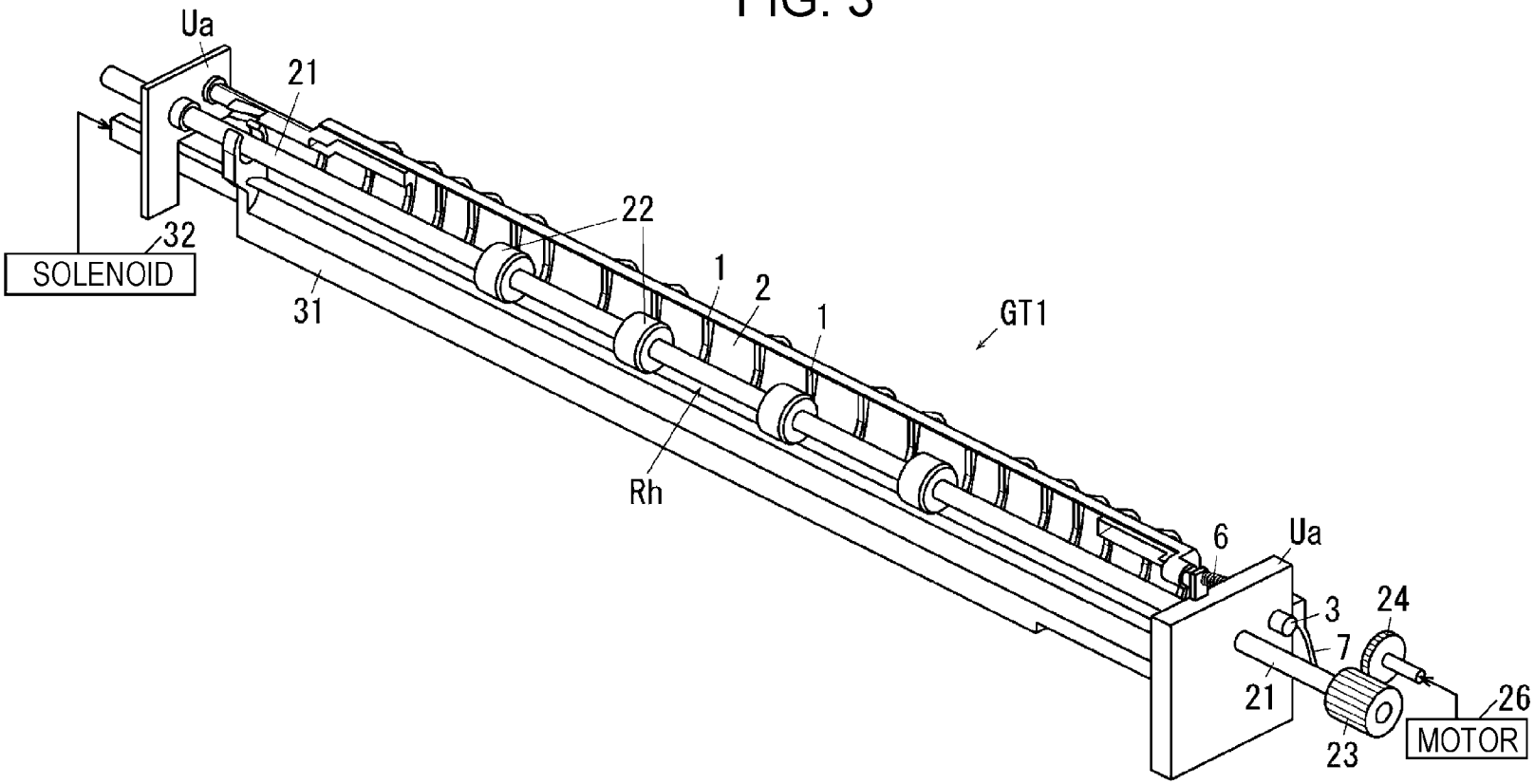
FIG. 3 is a perspective view of a related portion of a medium transport device according to the example 1.

FIG. 3 is a perspective view of a related portion of a medium transport device according to the example 1.

Figure 4:
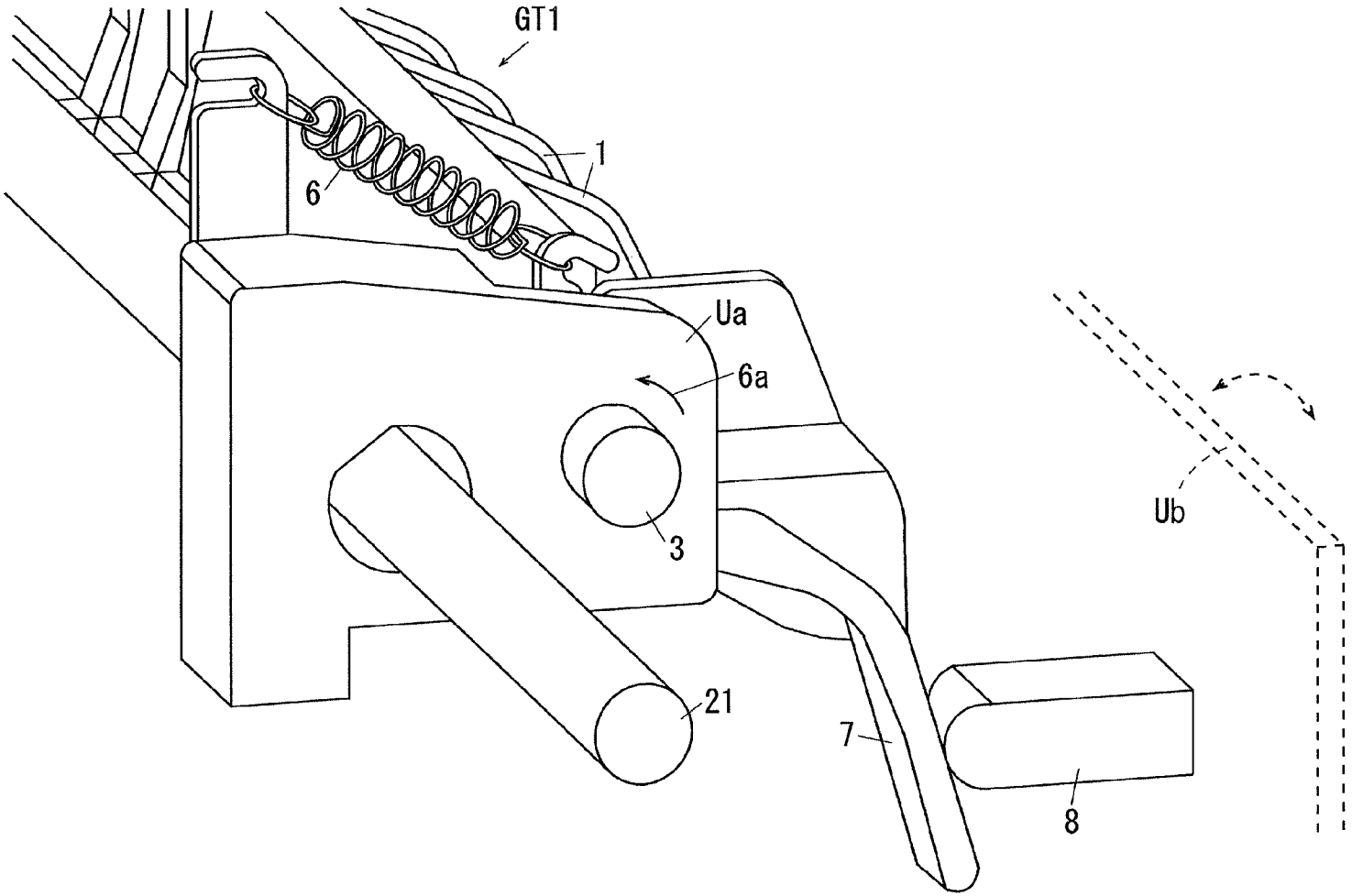
FIG. 4 is an enlarged view of a rear end portion of the medium transport device according to the example 1.

FIG. 4 is an enlarged view of a rear end portion of the medium transport device according to the example 1.

Figure 5B:
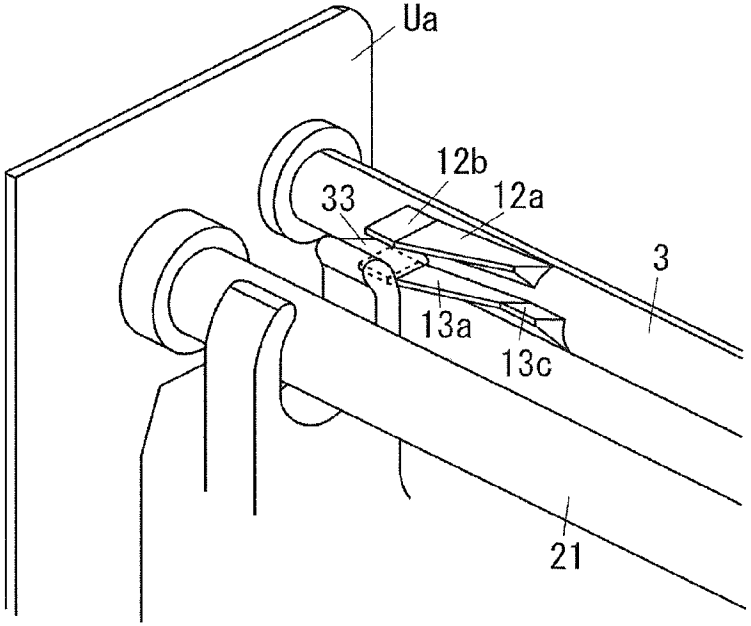
FIGS. 5A and 5B illustrate an interlocking member according to the example 1, where
Figure 5A:
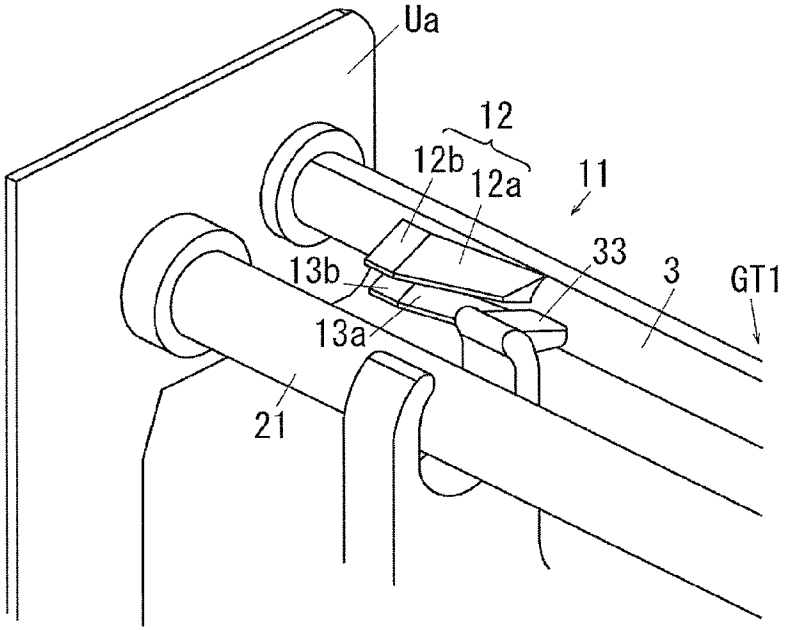

FIGS. 5A and 5B illustrate an interlocking member according to the example 1, where FIG. 5A illustrates the interlocking member in a first gate position, and FIG. 5B illustrates the interlocking member in a second gate position.

Figure 6A:
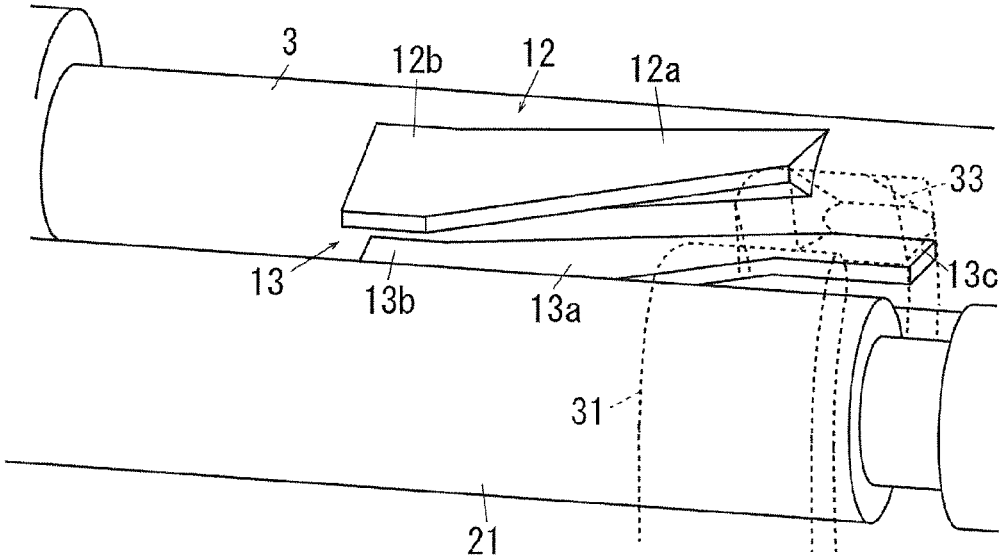
FIGS. 6A and 6B are enlarged views of a related portion illustrated in FIGS. 5A and 5B, where
Figure 6B:
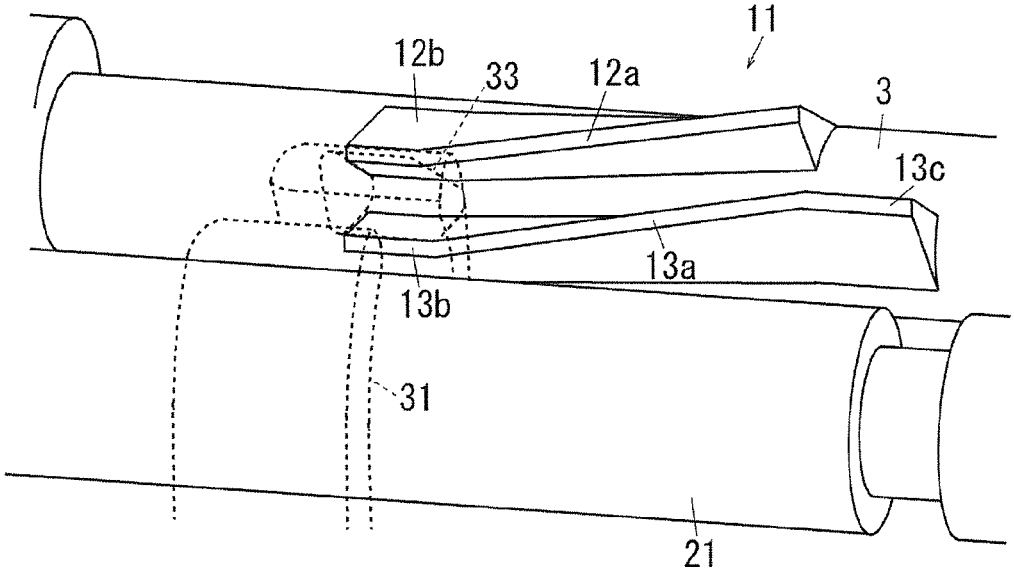

FIGS. 6A and 6B are enlarged views of a related portion illustrated in FIGS. 5A and 5B, where FIG. 6A illustrates the interlocking member in the first gate position, and FIG. 5B illustrates the interlocking member in the second gate position.

Figure 7B:
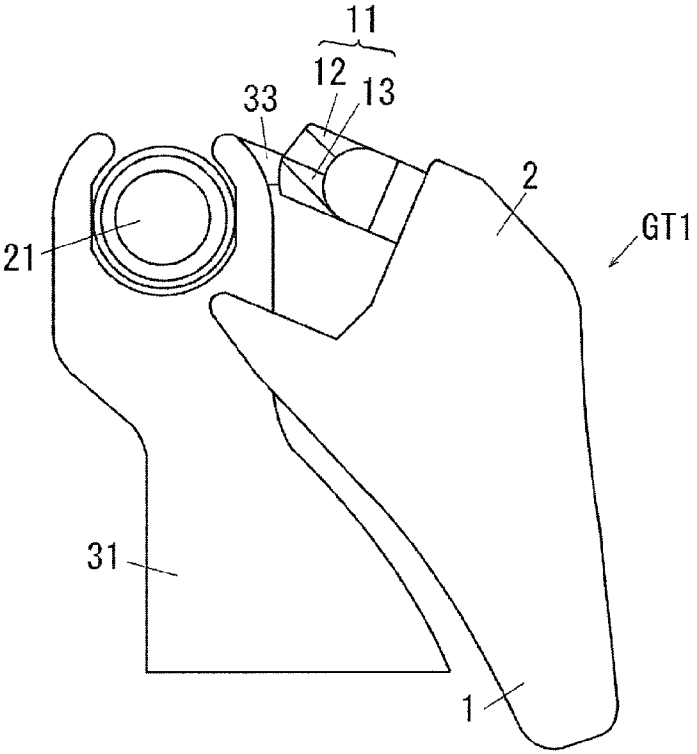
FIGS. 7A and 7B illustrate a gate and a discharging roller according to the example 1, where
Figure 7A:
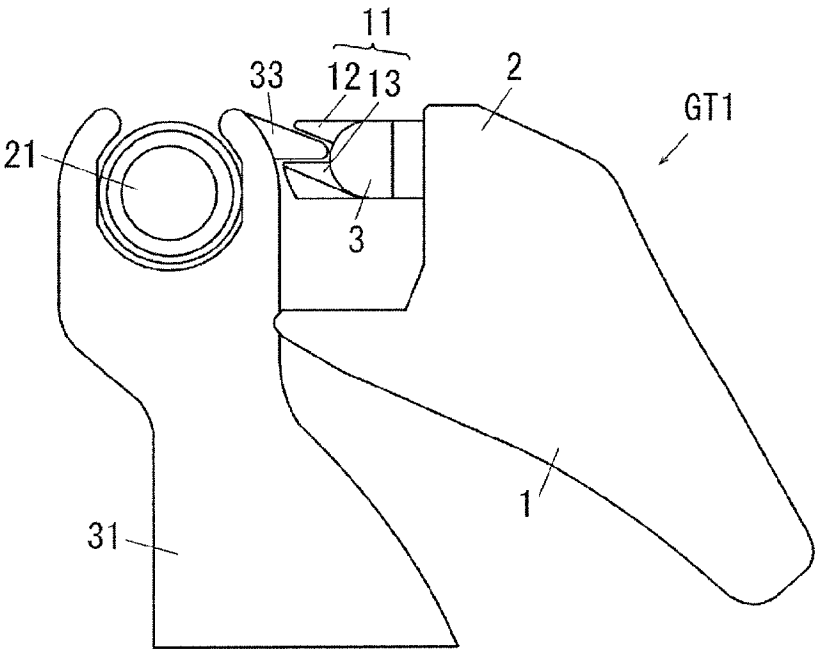

FIGS. 7A and 7B illustrate a gate and a discharging roller according to the example 1, where FIG. 7A illustrates the gate and the discharging roller in the first gate position, and FIG. 7B illustrates the gate and the discharging roller in the second gate position.

In FIGS. 3 to 7, the gate GT1 according to the example 1 includes multiple plate-shaped gate bodies 1 arranged at intervals in the width direction of the recording sheet S. The gate bodies 1 are coupled together with a coupling portion 2, extending in the width direction of the recording sheet S. The gate bodies 1 thus form a comb shape. Shafts 3 are disposed at the outer ends of the coupling portion 2.

The shafts 3 are rotatably supported by shaft bearings of the frame Ua.

To the rear of the gate GT1, an end of a gate spring 6, which is an example of an urging member, is coupled. The gate spring 6 has the other end supported by the frame Ua. In FIG. 4, the gate spring 6 urges the gate GT1 in a direction of arrow 6*a*, that is, in a direction from the second gate position to the first gate position.

At the rear end portion of the gate GT1, a positioning plate 7, which is an example of a positioned member, is disposed. The positioning plate 7 comes into contact with a stopblock 8 on an open-close cover Ub, which renders the reverse path SH6 open or closed, and fixes the position of the gate GT1 at the first gate position.

When the open-close cover Ub is opened, the positioning plate 7 is no longer in contact with the stopblock 8, which is an example of a positioning member, and the gate GT1 is allowed to rotate in the direction of arrow 6*a* from the first gate position with the force of the gate spring 6. In this state, in case of a paper jam caused around the gate GT1, visual check of the jammed sheet or removal of the jammed sheet is facilitated by opening the open-close cover Ub.

In FIGS. 3 and 5 to 7, the front shaft 3 includes a guide rail 11, which is an example of a second interlocking member. The guide rail 11 includes an upper rail 12 and a lower rail 13. The upper rail 12 includes an inclined portion 12*a*, which is inclined with respect to the axial direction of the shaft 3 and protrudes toward the output roller Rh, and a horizontal portion 12*b*, which extends from the front end of the inclined portion 12*a* in the axial direction. The inclined portion 12*a* and the horizontal portion 12*b* are smoothly connected together to form a curved surface, or, a round shape. Thus, an interlock hook 33, described below, moves smoothly.

The lower rail 13 includes an inclined portion 13*a* and a front horizontal portion 13*b*, spaced apart from and extending parallel to the inclined portion 12*a* and the horizontal portion 12*b* of the upper rail 12. The lower rail 13 of the example 1 includes a rear horizontal portion 13*c*, which extends rearward from the rear end of the inclined portion 13*a* in the axial direction. Thus, in the example 1, the upper rail 12 does not have a portion opposing the rear horizontal portion 13*c*. The inclined portion 13*a*, the front horizontal portion 13*b*, and the rear horizontal portion 13*c* of the lower rail 13 are smoothly connected together to form a rounded shape.

Thus, the guide rail 11 according to the example 1 is formed helically around the shaft 3.

On the right side of the gate GT1, that is, downstream of the gate GT1 in the sheet transport direction, the output roller Rh is disposed. The output roller Rh includes a rotation shaft 21, and roller bodies 22, arranged at intervals in the sheet width direction along the rotation shaft 21. Driven rollers of the output roller Rh (disposed above the roller bodies 22) are not illustrated.

The rotation shaft 21 of the output roller Rh is supported to be rotatable relative to the frame Ua and movable in the axial direction (sheet width direction). A gear 23 is supported at the rear end of the rotation shaft 21. The gear 23 is engaged with an intermediate gear 24. The gear 23 according to the example 1 is longer in the axial direction than the intermediate gear 24. The gears 23 and 24 are spur gears. Thus, while the gears 23 and 24 are engaged together, the rotation shaft 21 and the gear 23 are movable in the axial direction and the driving force is transmittable when they move in the axial direction. The intermediate gear 24 receives a driving force from a motor 26, which is an example of a driving source, via a gear train not illustrated.

Below the rotation shaft 21, an offset frame 31, which is an example of a movable frame, is disposed. The offset frame 31 rotatably supports the rotation shaft 21, and is movable in the sheet width direction together with the rotation shaft 21. The offset frame 31 is rendered movable by a solenoid 32, which is an example of a driving source, in the front-rear direction. In response to driving of the solenoid 32, the offset frame 31 moves in the front-rear direction, and the rotation shaft 21 moves in the front-rear direction integrally with the movement of the offset frame 31.

Thus, when the recording sheet S is to be discharged to the lower paper output tray TRh, if the solenoid 32 operates while the rear end portion of the recording sheet S is held between the output roller Rh, that is, while the trailing end of the recording sheet S is passing through the gate GT1, the recording sheet S is discharged to the lower paper output tray TRh while moving in the width direction. In other words, recording sheets S are discharged in an offset manner. Thus, recording sheets S are sorted to the front side (near side) and the rear side (far side) on the lower paper output tray TRh.

In FIGS. 5A, 5B, 6A, and 6B, at the front portion of the offset frame 31, the interlock hook 33, which is an example of a first interlocking member, is disposed. The interlock hook 33 is disposed to face or adjacent to the rear horizontal portion 13*c* of the lower rail 13 while the offset frame 31 is moved to the first offset position on the rear side. The interlock hook 33 passes between the upper rail 12 and the lower rail 13 when the offset frame 31 is moved to the front.

The components including the offset frame 31, the solenoid 32, and the interlock hook 33 constitute an offset mechanism 31+32+33, which is an example of a medium offsetting member according to an example. The guide rail 11 and the interlock hook 33 constitute an interlocking member 11+33 of the example 1. The output roller Rh, the gate GT1, and the components denoted with 1 to 33 constitute the medium transport device according to the example 1.

Effects of Example 1

In the copying machine U according to the example 1 having the above structure, the gate GT1 has to move to the first gate position when the recording sheet S is to be discharged to the lower paper output tray TRh. Here, the solenoid 32 is kept off (in the nonoperational state), and the gate GT1 is held in the first gate position with the force of the gate spring 6. The gate GT1 is fixed in the first gate position with the positioning plate 7 and the stopblock 8 coming into contact with each other.

In this state, the interlock hook 33 faces and is adjacent to the rear horizontal portion 13*c*. Thus, the gate GT1 that is to rotate to the second gate position is prevented from moving as a result of the rear horizontal portion 13*c* coming into contact with the interlock hook 33 (in other words, the movement of the gate GT1 is restricted or limited).

When the recording sheet S is to be discharged to the upper paper output tray TRh2 or to be subjected to double-side printing, the gate GT1 has to move to the second gate position. Here, the solenoid 32 is turned on (in the operational state). When the solenoid 32 is turned on, the offset frame 31 moves forward, and the interlock hook 33 moves forward. When the interlock hook 33 moves forward, the helical guide rail 11, through which the interlock hook 33 passes, is pushed to rotate the shaft 3 and move the gate GT1 to the second gate position.

Subsequently, to transport the recording sheet S toward the reverse path SH6 for double-side printing, the gate GT1 needs to move to the first gate position. When the recording sheet S is to be transported to the reverse path SH6, the solenoid 32 is switched from on to off. Thus, the gate GT1 rotates toward the first gate position with the force of the gate spring 6. With the rotation of the gate GT1, the guide rail 11 is rotated in the direction of arrow 6*a*, the interlock hook 33 is pushed, and the offset frame 31 and the rotation shaft 21 are moved rearward.

Thus, in the medium transport device according to the example 1, the gate GT1 moves between the first gate position and the second gate position in conjunction with the operation or the stop of the solenoid 32. Specifically, the gate GT1 moves in conjunction with the offset mechanism.

Here, in the structure of an existing gate, the gate is held in the first gate position according to the example 1 with only the force of spring. This is because, usually, discharging the recording sheets to the lower paper output tray in a single-side printing is more frequently performed than the double-side printing. Thus, the use of a spring is reasonable to hold the gate in the frequently placed first gate position without electric power, and to move the gate to the second gate position with the operation of a driving source (with electric power) such as a motor or a solenoid for double-side printing, which is performed less frequently.

Here, the recording sheets are guided while being in contact with the gate held with the force of the spring. If the recording sheets are stiff media, such as cardboard, such recording sheets press the gate with a strong force. Particularly, the leading ends of the recording sheets in the transport direction collide against the gate with a strong force.

In the existing technology for holding the gate in the first gate position with only a spring, the spring force may be insufficient and allow the gate to rotate toward the second gate position if the gate receives a strong force from the recording sheet in the structure, as in the example 1 where the gate in the first gate position also guides the recording sheet to the reverse path. When the gate rotates, the recording sheet may be transported rearward to the fixing device, instead of the reverse path, and may be guided erroneously.

Continuously operating a motor or using a highly elastic spring as a gate spring to transport a recording sheet to the reverse path to avoid erroneous guide may increase the running cost or manufacturing cost. Moreover, a highly elastic spring allows the gate to forcibly rotate when the solenoid is turned off, and to be returned to the first gate position and stop by colliding against the stopblock with a large noise (unusual sound).

To avoid these, in the example 1, the interlock hook 33 is located close to the rear horizontal portion 13*c* when the gate GT1 is moved to the first gate position. Thus, when the gate GT1 is pressed by the recording sheet S to move toward the second gate position, the rear horizontal portion 13*c* comes into contact with the interlock hook 33 and blocks rotation of the gate GT1. The gate GT1 is thus prevented from moving from the first gate position, so that erroneous guide of the recording sheet S is prevented.

Particularly, in the example 1, a spring exerting a force of returning the gate GT1 to the first gate position is sufficient for the gate spring 6, and a strong spring resistant to the impact caused when the recording sheet S collides against the gate GT1 is not needed. This structure thus employs a spring having lower elasticity than a spring for an existing technology for holding the gate in the first gate position using only the spring.

The gate GT1 returns from the second gate position to the first gate position with the gate spring 6. Thus, the example 1 does not involve the use of electric power for the return. Particularly, in the example 1, the gate GT1 is allowed to be held in the frequently placed first gate position without operating the solenoid 32.

The example 1 allows the gate GT1 to move between the first gate position and the second gate position using the solenoid 32, which is a driving source of an offset discharging mechanism. An existing structure includes a separate driving source for moving the gate GT1. In the example 1, in contrast, the solenoid 32, serving as the driving source of the offset discharging mechanism, is also used for moving the gate GT1.

In the example 1, the upper rail 12 does not face the interlock hook 33 from above when the gate GT1 is moved to the first gate position. In other words, the upper rail 12 has its rear portion open to the lower rail 13. Thus, when the open-close cover Ub is opened and the gate GT1 is to rotate in the direction of arrow 6*a*, or away from the second gate position, with the force of the gate spring 6, the interlock hook 33 does not come into contact with the upper rail 12, and the guide rail 11 is capable of passing or rotating downward. Thus, the gate GT1 is rendered rotatable in the direction of arrow 6*a*. The area near the gate GT1 is allowed to be open widely. The wide-open area further facilitates removability of jammed sheets than the structure including an upper rail 12 having a portion opposing the interlock hook 33 when the gate GT1 is moved to the first gate position.

Modified Example

Thus far, the examples of the present disclosure have been descried in detail. However, the disclosure is not limited to the above-described examples, and may be modified in various manners within the scope of the gist of the present disclosure described in the scope of claims. Modified examples H01 to H11 of the present disclosure are described, below, by way of examples.

H01

In the above examples, the copying machine U has been described as an example of an image forming apparatus. The present disclosure is not limited to this, however. The image forming apparatus is applicable to a FAX machine, or a multifunctional printer having multiple functions such as a FAX machine, a printer, and a copying machine. The image forming apparatus is not limited to an electrophotographic image forming apparatus, and is applicable to an image forming apparatus of any image forming form such as ink jet printing, or photolithographic printing including thermal head printing. In addition, the image forming apparatus is not limited to an image forming apparatus for multi-color development, and may be an image forming apparatus for forming single-color or monochrome images.

H02

The above example has described a structure, by way of example, including the paper output trays TRh and TRh2 vertically arranged in two levels. However, the structure may include paper output trays arranged in three or more levels. The above example has described a structure, by way of example, including a medium transport device disposed in the printer unit U1. This is not the only possible structure, however. The disclosure is also applicable to a structure for a postprocessor including a transport path including a gate.

H03

The above example has described a structure, by way of example, including the solenoid 32 as an example of a driving source. This is not the only possible structure, however. The disclosure is also applicable to a structure including, for example, a motor, a gear, a pinion, and a rack.

H04

The above example has described a structure, by way of example, in which the gate spring 6 is used to return the offset mechanism from the second offset position on the front side to the first offset position on the rear side. This is not the only possible structure, however. The offset mechanism may be returned to the first offset position with a spring or the offset mechanism may be operated by a motor.

H05

In the above example, desirably, the solenoid 32 is operated to move the gate to the second gate position, but the solenoid 32 may be operated to move the gate to the first gate position.

H06

The above example has described a structure including the open-close cover Ub that includes the stopblock 8. This is not the only possible structure, however. For example, the frame Ua may include the stopblock 8.

H07

The above example has described a structure, by way of example, in which the guide rail 11 includes the inclined portions 12*a* and 13*a* and the horizontal portions 12*b*, 13*b*, and 13*c*. This is not the only possible structure, however. For example, the guide rail may have curved surfaces helically continuing around the shaft 3. The guide rail desirably includes the horizontal portions 12*b*, 13*b*, and 13*c*, but may not include the horizontal portions 12*b*, 13*b*, and 13*c*. The above example has described a structure, by way of example, in which the guide rail 11 and the interlock hook 33 are disposed on the front side in the axial direction. However, the guide rail 11 and the interlock hook 33 may be disposed appropriately in accordance with the design or specifications, such as disposed on the rear side in the axial direction, or multiple guide rails and interlock hooks may be disposed, instead.

H08

In the above example, desirably, the upper rail 12 does not have a rear horizontal portion, but may include a rear horizontal portion.

H09

In the above example, the guide rail and the interlock hook may be interchanged, that is, the offset frame 31 may have a shape of a guide rail, and the gate GT1 may include an interlock hook.

H010

In the above example, the gate GT1 is in a first orientation when the offset frame 31 is located at the front, and the gate GT1 is in a second orientation when the offset frame 31 is located at the rear. However, this arrangement may be reversed: the gate GT1 may be in the first orientation when the offset frame 31 is located at the rear, and the gate GT1 may be in the second orientation when the offset frame 31 is located at the front.

H011

In the above example, a spring exerting a force to hold the gate GT1 is located at the front, and the guide rail 11 and the interlock hook 33 are located at the rear. However, this is not the only possible arrangement. Specifically, a spring may be located at the rear, and the guide rail 11 and the interlock hook 33 may be located at the front, or the spring, the guide rail 11, and the interlock hook 33 may be collectively located at the front or rear.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium transport device, comprising:

a transporting member that transports a medium toward a medium accommodating member;

a medium offsetting member that moves the transporting member in a medium width direction to transport the medium to the medium accommodating member at positions shifted in the medium width direction;

a guide member that is located upstream of the transporting member in a medium transport direction, the guide member being movable between a first position, in which the guide member guides the medium toward the medium accommodating member, and a second position, in which the guide member guides the medium to a destination different from the medium accommodating member, to guide the medium; and an interlocking member that moves the guide member between the first position and the second position in conjunction with a movement of the medium offsetting member in a width direction of the medium offsetting member.

2. An image forming apparatus, comprising:

an image forming member that forms an image on a medium; and the medium transport device according to claim 1 that transports a medium on which an image is formed by the image forming member.

3. A medium transport device, comprising:

a transporting member that transports a medium toward a medium accommodating member;

a medium offsetting member that moves the transporting member in a medium width direction to transport the medium to the medium accommodating member at positions shifted in the medium width direction;

a guide member that is located upstream of the transporting member in a medium transport direction, the guide member being movable between a first position, in which the guide member guides the medium toward the medium accommodating member, and a second position, in which the guide member guides the medium to a destination different from the medium accommodating member, to guide the medium; and an interlocking member that includes a first interlocking member disposed on the medium offsetting member, and a second interlocking member disposed on the guide member, the second interlocking member moving the guide member between the first position and the second position while being in contact with the first interlocking member in response to a movement of the medium offsetting member in a width direction of the medium offsetting member.

4. The medium transport device according to claim 3, wherein the second interlocking member extends from a first position to a second position in the medium width direction and guides the first interlocking member.

5. The medium transport device according to claim 4, wherein the guide member is rotatable between the first position and the second position about a rotation shaft, and wherein the second interlocking member is inclined further with respect to a circumferential direction of the rotation shaft as the second interlocking member extends further from a first position to a second position in the medium width direction.

6. The medium transport device according to claim 5, wherein, when the guide member is in the first position, the second interlocking member is in contact with the first interlocking member to restrict the guide member from moving toward the second position.

7. The medium transport device according to claim 6, wherein, the second interlocking member has a cut that allows the first interlocking member to pass therethrough in a direction in which a medium path is rendered open or in a direction in which the guide member moves away from the second position, when the guide member is in the first position.

8. The medium transport device according to claim 4, wherein, when the guide member is in the first position, the second interlocking member is in contact with the first interlocking member to restrict the guide member from moving toward the second position.

9. The medium transport device according to claim 8, wherein, the second interlocking member has a cut that allows the first interlocking member to pass therethrough in a direction in which a medium path is rendered open or in a direction in which the guide member moves away from the second position, when the guide member is in the first position.

10. The medium transport device according to claim 3, wherein the guide member is rotatable between the first position and the second position about a rotation shaft, and wherein the second interlocking member is inclined further with respect to a circumferential direction of the rotation shaft as the second interlocking member extends further from a first position to a second position in the medium width direction.

11. The medium transport device according to claim 10, wherein, when the guide member is in the first position, the second interlocking member is in contact with the first interlocking member to restrict the guide member from moving toward the second position.

12. The medium transport device according to claim 11, wherein, the second interlocking member has a cut that allows the first interlocking member to pass therethrough in a direction in which a medium path is rendered open or in a direction in which the guide member moves away from the second position, when the guide member is in the first position.

13. The medium transport device according to claim 3, wherein, when the guide member is in the first position, the second interlocking member is in contact with the first interlocking member to restrict the guide member from moving toward the second position.

14. The medium transport device according to claim 13, wherein, the second interlocking member has a cut that allows the first interlocking member to pass therethrough in a direction in which a medium path is rendered open or in a direction in which the guide member moves away from the second position, when the guide member is in the first position.

* * * * *